US011773852B2

(12) United States Patent
Inaba et al.

(10) Patent No.: US 11,773,852 B2
(45) Date of Patent: Oct. 3, 2023

(54) SCROLL COMPRESSOR

(71) Applicant: SANDEN AUTOMOTIVE COMPONENTS CORPORATION, Isesaki (JP)

(72) Inventors: Hironobu Inaba, Isesaki (JP); Taizo Sato, Isesaki (JP); Tetsuya Imai, Isesaki (JP)

(73) Assignee: SANDEN CORPORATION, Isesaki (JP)

( * ) Notice: Subject to any disclaimer, the term of this patent is extended or adjusted under 35 U.S.C. 154(b) by 165 days.

(21) Appl. No.: 17/437,993

(22) PCT Filed: Mar. 16, 2020

(86) PCT No.: PCT/JP2020/011347
§ 371 (c)(1),
(2) Date: Sep. 10, 2021

(87) PCT Pub. No.: WO2020/189601
PCT Pub. Date: Sep. 24, 2020

(65) Prior Publication Data

US 2022/0178370 A1 Jun. 9, 2022

(30) Foreign Application Priority Data

Mar. 20, 2019 (JP) ..... 2019-052789

(51) Int. Cl.
*F04C 18/02* (2006.01)

(52) U.S. Cl.
CPC ..... *F04C 18/0276* (2013.01); *F04C 18/0215* (2013.01)

(58) Field of Classification Search
CPC ..... F04C 18/0215–0292; F04C 2/025; F01C 1/0207–0292
See application file for complete search history.

(56) References Cited

U.S. PATENT DOCUMENTS 4,477,238 A 10/1984 Terauchi

FOREIGN PATENT DOCUMENTS

JP 07-019187 A 1/1995
JP 11-190287 A 7/1999
(Continued)

OTHER PUBLICATIONS

Japan Patent Office, International Search Report issued in International Application No. PCT/JP2020/011347, dated Jun. 2, 2020.

*Primary Examiner* — Mark A Laurenzi
*Assistant Examiner* — Xiaoting Hu
(74) *Attorney, Agent, or Firm* — Baker Botts L.L.P.

(57) ABSTRACT

[Problem] A scroll compressor is provided which effectively suppresses the occurrence of localized contact caused by deformation of a fixed scroll or a movable scroll due to the influence of a compressive reaction force or thermal expansion and shortens a break-in time. [Solution] Laps 24 and 32 of a fixed scroll 21 and a movable scroll 22 are constituted to have a plurality of step portions between a winding end portion at an outermost periphery and a winding start portion at an innermost periphery and decrease stepwise in height toward the winding start portion from the winding end portion. The position and height of each step portion are set so that when the spiral laps 24 and 32 are expanded on a predetermined plane, a base point of each step portion is placed on a predetermined arc drawn on the plane.

3 Claims, 5 Drawing Sheets

(56) References Cited

FOREIGN PATENT DOCUMENTS

| | | | | | |
|---|---|---|---|---|---|
| JP | 2002-364561 | A | | 12/2002 | |
| JP | 2007046582 | A | * | 2/2007 | ..... F04C 18/0276 |
| JP | 2017-015000 | A | | 1/2017 | |

* cited by examiner

SCROLL COMPRESSOR

CROSS-REFERENCE TO RELATED APPLICATIONS

This application is a U.S. National Stage Patent Application under 37 U.S.C. § 371 of International Patent Application No. PCT/JP2020/011347, filed on Mar. 16, 2020, which claims the benefit of Japanese Patent Application No. JP 2019-052789, filed on Mar. 20, 2019, the disclosures of each of which are incorporated herein by reference in their entirety.

TECHNICAL FIELD

The present invention relates to a scroll compressor which compresses a working fluid in a compression chamber formed between laps of both a fixed scroll and a movable scroll by revolving and turning the movable scroll with respect to the fixed scroll.

BACKGROUND ART

This type of scroll compressor conventionally includes a compression mechanism constituted of a fixed scroll having a spiral lap on the surface of a mirror plate and a movable scroll having a spiral lap on the surface of a mirror plate and is configured in such a manner that a compression chamber is formed between the laps of the respective scrolls with the laps facing each other, and the movable scroll is revolved and turned with respect to the fixed scroll by a motor to thereby move the volume of the compression chamber from the outside to the inside while reducing it, so that a working fluid (refrigerant) is compressed.

In this case, in each scroll, the innermost periphery (central part) of the spiral thereof is deformed into a convex shape due to the influence of a compressive reaction force and thermal expansion. Consequently, localized contact occurs and volumetric efficiency decreases, but by effecting operation for a prescribed time, the volumetric efficiency is improved with time and saturates at a certain time (break-in time). This is because due to wear with time, a localized contact portion is cut to an acceptable shape, that is, it has familiarized. However, when the operation is performed under high load conditions in a wear-free state at the start of the operation (a state before it has become familiar), there is a high risk that the surface pressure of the localized contact portion will increase and the scroll will be damaged.

Therefore, it is considered that the height of the lap is gradually lowered from the winding end port ion at the outermost periphery of the spiral in advance (refer to, for example, Patent Document 1, Patent Document 2, and Patent Document 3). According to this, it is considered possible to form a shape in which localized contact due to the influence of a compressive reaction force and thermal expansion does not occur.

CITATION LIST

Patent Documents

Patent Document 1: Japanese Patent Application Laid-Open No. 2017-15000

Patent Document 2: Japanese Patent Application Laid-Open No. 2002-364561

Patent Document 3: Japanese Patent Application Laid-Open No. Hei 11(1999)-190287

SUMMARY OF THE INVENTION

Problems to be Solved by the Invention

A problem however arose in that the actual wear of the scroll could not be dealt with only by such conventional measures, and the occurrence of localized contact could not be effectively suppressed.

The present invention has been made to solve the above-mentioned conventional technical problems, and an object thereof is to provide a scroll compressor which effectively suppresses the occurrence of localized contact caused by deformation of a fixe scroll or a movable scroll due to the influence of a compressive reaction force and thermal expansion and shortens a break-in time.

Means for Solving the Problems

In order to solve the above problems, there is provided a scroll compressor of the present invention, which includes a compression mechanism having a fixed scroll and a movable scroll respectively formed on surfaces of mirror plates with spiral laps facing each other. The scroll compressor is characterized in that the movable scroll is revolved and turned with respect to the fixed scroll to move a compression chamber formed between the laps of both scrolls from the outside to the inside while reducing the compression chamber to thereby compress a working fluid, and in that the laps of the fixed scroll and the movable scroll are configured to have a plurality of step portions between a winding end portion at an outermost periphery and a winding start portion at an innermost periphery and decrease stepwise in height toward the winding start portion from the winding end portion, and the position and height of each step portion are set so that a base point of each step portion is placed on a predetermined arc drawn on a predetermined plane when each of the spiral laps is expanded on the predetermined plane.

The scroll compressor of the invention of claim 2 is characterized in that in the above invention, each step portion has a concentric arc shape.

The scroll compressor of the invention of claim 3 is characterized in that in the above invention, each step portion has an arc shape concentric with a base circle of a spiral of each lap or the mirror plate.

The scroll compressor of the invention of claim 4 is characterized in that in the above respective inventions, the step portion on the outermost side is positioned 180 deg or more inside from the winding end portion.

The scroll compressor of the invention of claim 5 is characterized in that in the above invention, the step portion on the outermost side is positioned 270 deg inside from the winding end portion.

Advantageous Effect of the Invention

According to the present invention, in a scroll compressor which includes a compression mechanism having a fixed scroll and a movable scroll respectively formed on surfaces of mirror plates with spiral laps facing each other, and in which the movable scroll is revolved and turned with respect to the fixed scroll to move a compression chamber formed between the laps of both scrolls from the outside to the inside while reducing the compression chamber thereby to compress a working fluid, the laps of the fixed scroll and the movable scroll are configured to have a plurality of step portions between a winding end portion at an outermost periphery and a winding start portion at an innermost periphery and decrease stepwise in height toward the winding start portion from the winding end portion, and the position and height of each step portion are set so that a base point of each step portion is placed on a predetermined arc drawn on a predetermined plane when the spiral laps are expanded on the predetermined plane. It is therefore possible to set the height of the lap of each scroll to a form close to an actual shape of each scroll of a state of being worn by localized contact due to the influence of a compressive reaction force and thermal expansion, i.e., a familiarized state. Consequently, the occurrence of the localized contact can be effectively suppressed, and a so-called break-in time until volumetric efficiency is saturated can be significantly shortened.

In particular, as in the invention of claim 2, each step portion is set to a concentric arc shape. More preferably, as in the invention of claim 3, each step portion is set to an arc shape concentric with a base circle of a spiral of each lap or the mirror plate. Consequently, the height of the lap of each scroll can be made to even more accurately correspond to an actual wear shape of the scroll, and the occurrence of the localized contact can be suppressed even more effectively.

Further, as in the invention of claim 3, the outermost step portion is located 180 deg or more inside from the winding end portion, more preferably, 270 deg inside from the winding end portion as in the invention of claim 4. Consequently, the stability at the time that each scroll is placed with the lap facing down is improved, and the standard at time of setting the height of the lap also becomes easy to be taken.

MODE FOR CARRYING OUT THE INVENTION

Figure 1:
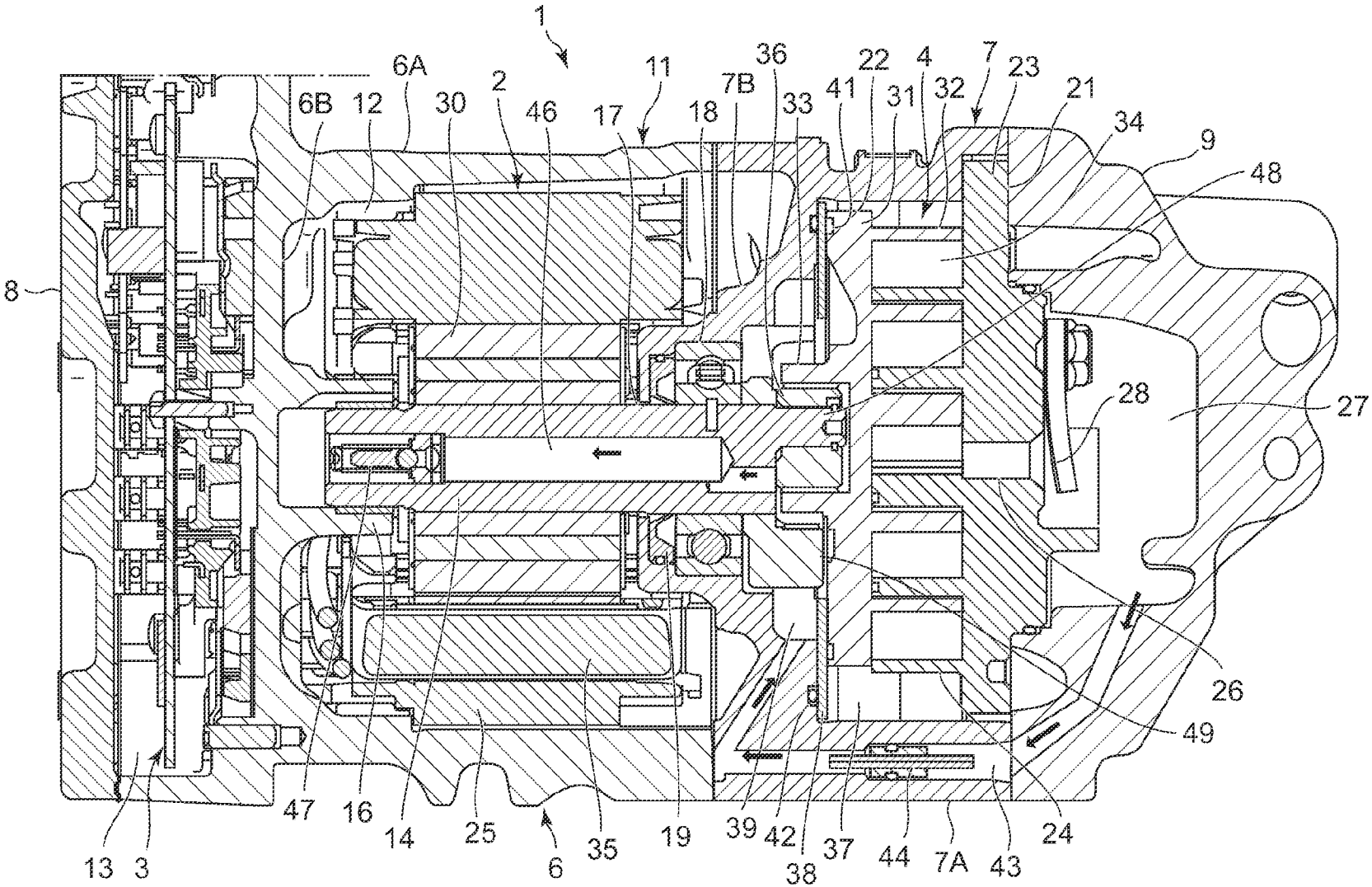
FIG. 1 is a cross-sectional view of a scroll compressor of an embodiment to which the present invention is applied.

Hereinafter, an embodiment of the present invention will be described in detail with reference to the drawings. FIG. 1 is a cross-sectional view of a scroll compressor 1 of an embodiment to which the present invention is applied. The scroll compressor 1 of the embodiment is, for example, a so-called inverter-integrated scroll compressor which is used in a refrigerant circuit of a vehicle air conditioning device, sucks a carbon dioxide refrigerant as a working fluid of the vehicle air conditioning device, and compresses and discharges it, and which includes an electric motor 2, an inverter 3 for operating the electric motor 2, and a compression mechanism 4 driven by the electric motor 2.

The scroll compressor 1 of the embodiment includes a main housing 6 which accommodates the electric motor 2 and the inverter 3 thereinside, a compression mechanism housing 7 which accommodates the compression mechanism 4 thereinside, an inverter cover 8, and a compression mechanism cover 9. Then, the main housing 6, the compression mechanism housing 7, the inverter cover 8, and the compression mechanism cover 9 are all made of metal (made of aluminum in the embodiment). They are integrally joined to constitute a housing 11 of the scroll compressor 1.

The main housing 6 is constituted of a tubular peripheral wall portion 6A and a partition wall portion 6B. The partition wall portion 6B is a partition wall which partitions the inside of the main housing 6 into a motor accommodating portion 12 accommodating the electric motor 2 and an inverter accommodating portion 13 accommodating the inverter 3. One end surface of the inverter accommodating portion 13 is open, and this opening is closed by the inverter cover 8 after the inverter 3 is accommodated therein.

The other end surface of the motor accommodating portion 12 is also open, and this opening is closed by the compression mechanism housing 7 after the electric motor 2 is accommodated therein. A support portion 16 for supporting one end portion (end portion on the side opposite to the compression mechanism 4) of a rotating shaft 14 of the electric motor 2 is protrusively provided at the partition wall portion 6B.

The compression mechanism housing 7 has an opening on the side opposite to the main housing 6, and this opening is closed by the compression mechanism cover 9 after the compression mechanism 4 is accommodated therein. The compression mechanism housing 7 is constituted of a tubular peripheral wall portion 7A and a frame portion 7B on one end side (main housing 6 side) thereof. The compression mechanism 4 is accommodated in a space partitioned by the peripheral wall portion 7A and the frame portion 7B. The frame portion 71 forms a partition wall which partitions the inside of the main housing 6 from the inside of the compression mechanism housing 7.

Further, the frame portion 7B is provided with a through hole 17 to insert the other end of the rotating shaft 14 of the electric motor 2 (the end on the compression mechanism 4 side). A front bearing 18 which supports the other end of the rotating shaft 14 is fitted to the compression mechanism 4 side of the through hole 17. Further, reference numeral 19 denotes a seal material which seals the outer peripheral surface of the rotating shaft 14 and the inside of the compression mechanism housing 7 at the portion of the through hole 17.

The electric motor 2 is constituted of a stator 25 around which a coil 35 is wound and a rotor 30. Then, for example, a direct current from a battery (not shown) of a vehicle is converted into a three-phase alternating current by the inverter 3, which is supplied to the coil 35 of the electric motor 2, so that the rotor 30 is configured to be rotationally driven.

Further, an unillustrated suction port is formed in the main housing 6. After the refrigerant sucked from the suction port passes through the inside of the main housing 6, the refrigerant is sucked into a suction portion 37 to be described later outside the compression mechanism 4 in the compression mechanism housing 7. Consequently, the electric motor 2 is cooled by the sucked refrigerant. In addition, the refrigerant compressed by the compression mechanism 4 is configured to be discharged from a discharge space 27 described later as a discharge side of the compression mechanism 4 through an unillustrated discharge port formed in the compression mechanism cover 9.

The compression mechanism 4 is constituted of a fixed scroll 21 and a movable scroll 22 both made of metal (aluminum alloy, magnesium alloy, or cast iron). The fixed scroll 21 integrally has a disk-shaped mirror plate 23 and a spiral lap 24 comprised of an involute shape or a curved line approximated thereto, which stands on the surface (one surface) of the mirror plate 23. The surface of the mirror plate 23 on which the lap 24 is vertically provided is fixed to the compression mechanism housing 7 as the frame portion 7B side. Here, in the embodiment, it is assumed that the center of the base circle of the spiral lap 24 coincides with the center of the mirror plate 23. A discharge hole 26 is formed in the center of the mirror plate 23 of the fixed scroll 21. The discharge hole 26 communicates with the discharge space 27 in the compression mechanism cover 9. Reference numeral 28 denotes a discharge valve provided in the opening on the back surface (the other surface) side of the mirror plate 23 in the discharge hole 26.

The movable scroll 22 is a scroll which revolves and turns with respect to the fixed scroll. 21, and integrally includes a disk-shaped mirror plate 31, a spiral lap 32 comprised of an involute shape or a curved line approximated thereto, which stands on the surface (one surface) of the mirror plate 31, and a boss portion 33 formed to protrude in the center of the back surface (the other surface) of the mirror plate 31. Here, in the embodiment, it is assumed that the center of the base circle of the spiral lap 32 coincides with the center of the mirror plate 31. The movable scroll 22 is arranged so that the lap 32 faces the lap 24 of the fixed scroll 21 and they face each other and mesh with each other with the protruding direction of the lap 32 as the fixed scroll 21 side, and a compression chamber 34 is formed between the laps 24 and 32.

That is, the lap 32 of the movable scroll 22 faces the lap 24 of the fixed scroll 21 and meshes with the lap 24 so that the tip of the lap 32 comes into contact with the surface of the mirror plate 23 and the tip of the lap 24 comes into contact with the surface of the mirror plate 31. The other end of the rotating shaft 14, that is, the end on the movable scroll 22 side is provided with a drive protrusion 48 which protrudes at a position eccentric from the axial center of the rotating shaft 14. Then, a columnar eccentric bush 36 is attached to the drive protrusion 48 and provided eccentrically from the axial center of the rotating shaft 14 at the other end of the rotating shaft 14.

In this case, the eccentric bush 36 is attached to the drive protrusion 48 at a position eccentric from the axial center of the eccentric bush 36. The eccentric bush 36 is fitted to the boss portion 33 of the movable scroll 22. Then, when the rotating shaft 14 is rotated together with the rotor 30 of the electric motor 2, the movable scroll 22 is configured to revolve and turn with respect to the fixed scroll 21 without rotating on its axis. Incidentally, reference numeral 49 denotes a balance weight attached to the outer peripheral surface of the rotating shaft 14 on the movable scroll 22 side from the front bearing 18.

Since the movable scroll. 22 revolves and turns eccentrically with respect to the fixed scroll 21, the eccentric direction and the contact position of each of the laps 24 and 32 are moved while rotating, and the compression chamber 34 having sucked the refrigerant from the above-mentioned suction portion 37 on the outside is gradually reduced in volume while moving from the outside to the inside. Consequently, the refrigerant is compressed and finally discharged from the central discharge hole 26 to the discharge space 27 through the discharge valve 28.

In FIG. 1, reference numeral 38 is an annular thrust plate. The thrust plate 38 is for partitioning a back pressure chamber 39 formed on the back surface side of the mirror plate 31 of the movable scroll 22 and the suction portion 37 as a suction pressure region outside the compression mechanism 4 in the compression mechanism housing 7. The thrush plate 38A is located outside the boss portion 33 and interposed between the frame portion 7B and the movable scroll 22. Reference numeral. 41 is a seal material which is attached to the back surface of the mirror plate 31 of the movable scroll 22 and abuts against the thrust plate 38. The back pressure chamber 39 and the suction portion 37 are partitioned by the seal material 41 and the thrust plate 38.

Incidentally, reference numeral 42 is a seal material which is attached to the surface of the frame portion 7B on the thrust plate 38 side, abuts against the outer peripheral portion of the thrust plate 38, and seals between the frame portion 7B and the thrust plate 38.

Further, in FIG. 1, reference numeral 43 denotes a back pressure passage formed from the compression mechanism cover 9 to the compression mechanism housing 7. An orifice 44 is installed in the back pressure passage 43. The back pressure passage 43 causes the inside of the discharge space 27 (the discharge side of the compression mechanism 4) in the compression mechanism cover 9 and the back pressure chamber 39 to communicate with each other, whereby as shown by an arrow in FIG. 1, the back pressure passage 43 is configured so that oil having discharge pressure adjusted to be reduced in pressure by the orifice 44 is mainly supplied to the back pressure chamber 39.

The pressure (back pressure) in the back pressure chamber 39 causes a back pressure load which presses the movable scroll 22 against the fixed scroll 21. Due to this back pressure load, the movable scroll. 22 is pressed against the fixed scroll 21 against a compressive reaction force from the compression chamber 34 of the compression mechanism 4, so that the contacts between the laps 24 and 32 and the mirror plates 31 and 23 are maintained, thereby making it possible to compress the refrigerant in the compression chamber 34.

On the other hand, an oil passage 46 extending in the axial direction is formed in the rotating shaft 14. A pressure adjusting valve 47 is provided in the oil passage 46 with being located on the support portion 16 side. The oil passage 46 communicates the back pressure chamber 39 with the inside of the main housing 6 (suction pressure region). The oil flowing into the back pressure chamber 39 from the back pressure passage 43 flows into the oil passage 46 from the inlet hole 52 and flows out into the main housing 6. However, the pressure adjusting valve 47 is made open when the pressure (back pressure) in the back pressure chamber 39 reaches the maximum value, and functions so that the back pressure does not rise any more.

Figure 2:
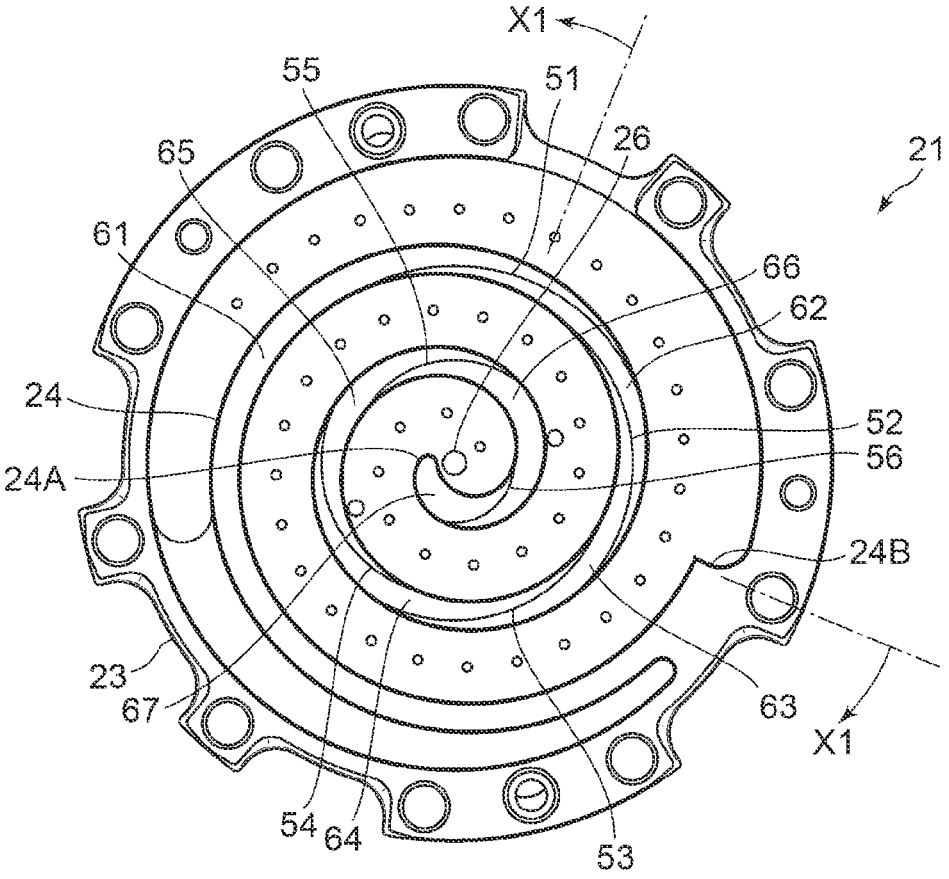
FIG. 2 is a plan view of a fixed scroll of the scroll compressor of FIG. 1 as viewed from the lap side.

Next, referring to FIGS. 2 to 6, the shapes of the tip portions of the lap 24 of the fixed scroll 21 and the lap 32 of the movable scroll 22, which constitute the compression mechanism 4 described above will be described. FIG. 2 is a plan view of the fixed scroll. 21 as viewed from the lap 24 side (front surface side), and FIG. 3 is a plan view of the movable scroll 22 as viewed from the lap 32 side (front surface side).

As shown in FIG. 2, the lap 24 of the fixed scroll 21 assumes a spiral shape extending from a winding start portion 24A at an innermost periphery to a winding end portion 24B at an outermost periphery. Further, at the tip portion of the lap 24, a plurality of (six places in the embodiment) step portions 51 to 56 are formed between the winding end portion 24B and the winding start portion 24A. The height of the lap 24 is configured to decrease stepwise toward the winding start portion 24A from the winding end portion 24B.

In the embodiment, the outermost step portion is denoted as 51, its inner step portion is denoted as 52, the further inner step portion is denoted as 53, the still further inner step portion is denoted as 54, the still further inner step portion is denoted as 55, and the innermost step portion is denoted as 56. Further, the tip portion high in height on the outermost side is denoted as 61, its inner tip portion is denoted as 62, the further inner tip portion is denoted as 63, the still further inner tip portion is denoted as 64, the still further inner tip portion is denoted as 65, the still further inner tip portion is denoted as 66, and the innermost tip portion is denoted as 67 respectively, all of which are constituted by these step portions 51 to 56.

Figure 3:
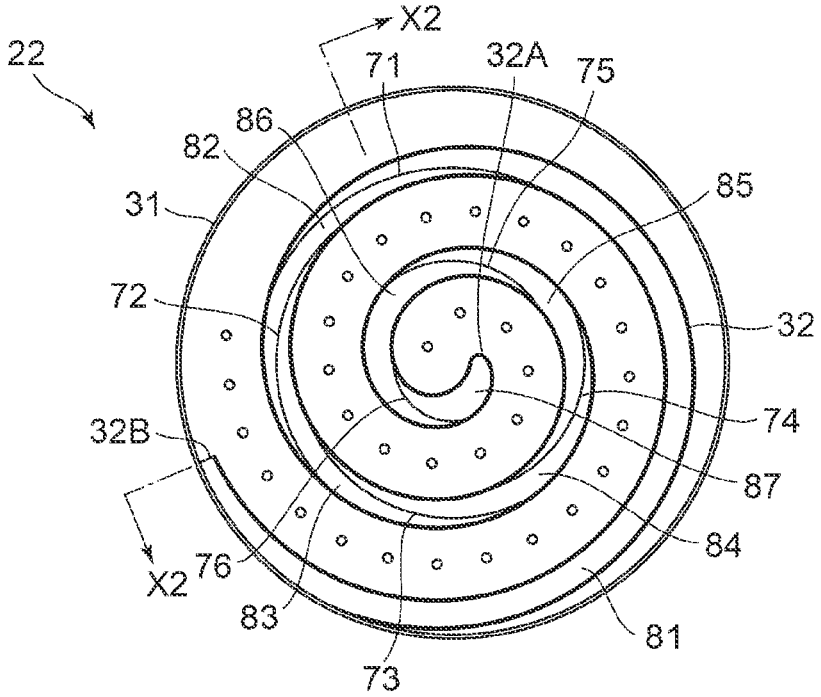
FIG. 3 is a plan view of a movable scroll of the scroll compressor of FIG. 2 as viewed from the lap side.

As shown in FIG. 3, the lap 32 of the movable scroll 22 also assumes a spiral shape extending from a winding start portion 32A at an innermost periphery to a winding end portion 32B at an outermost periphery. Further, even at the tip portion of the lap 32, a plurality of (six places in the embodiment) step portions 71 to 76 are formed between the winding end portion 32B and the winding start portion 32A. The height of the lap 32 is configured to decrease stepwise toward the winding start portion 32A from the winding end portion 32B.

In the embodiment, the outermost step portion is denoted as 71, its inner step portion is denoted as 72, the further inner step portion is denoted as 73, the still further inner step portion is denoted as 74, the still further inner step portion is denoted as 75, and the innermost step portion is denoted as 76. Further, the tip portion high in height on the outermost side is denoted as 81, its inner tip portion is denoted as 32, the further inner tip portion is denoted as 83, the still further inner tip portion is denoted as 34, the still further inner tip portion is denoted as 85, the still further inner tip portion is denoted as 86, and the innermost tip portion is denoted as 87 respectively, all of which are constituted by these step portions 71 to 76.

Here, as described above, in the fixed scroll 21 and the movable scroll 22, the innermost periphery (central portion) of the spiral of each of the laps 24 and 31 is deformed into a convex shape due to the influence of the compressive reaction force from the compression chamber 34 and thermal expansion. Therefore, localized contact occurs and volumetric efficiency decreases. Then, by performing operation for a prescribed time, the volumetric efficiency is improved with time and saturates at a certain time (break-in time), but this is because due to wear over time, a localized contact portion is cut to an acceptable shape, that is, it became familiar therewith. Thus, when the operation is performed under high load conditions without wear before such a break-in time elapses, there is a risk that the surface pressure of the localized contact portion will increase and the scrolls 21 and 22 will be damaged.

On the other hand, as a result of actually measuring the shapes of the scrolls 21 and 22 after such a break-in time as described above has elapsed, that is, measuring the shapes of the scrolls 21 and 22 after familiarization, it was turned out that the laps 24 and 31 were respectively cut into a shape made concave in cross section in an arcuate form from the outermost winding end portions 24B and 32B to the innermost winding start portions 24A and 32A.

Therefore, in the present invention, the positions and heights of the step portions 51 to 56 and 71 to 76 of the laps 24 and 32 of the fixed scroll 21 and the movable scroll 22 are set such that when the spiral laps 24 and 32 are expanded on a predetermined plane, the base points of the step portions 51 to 56 and 71 to 76 are placed on a predetermined arc drawn on the plane.

Figure 4:
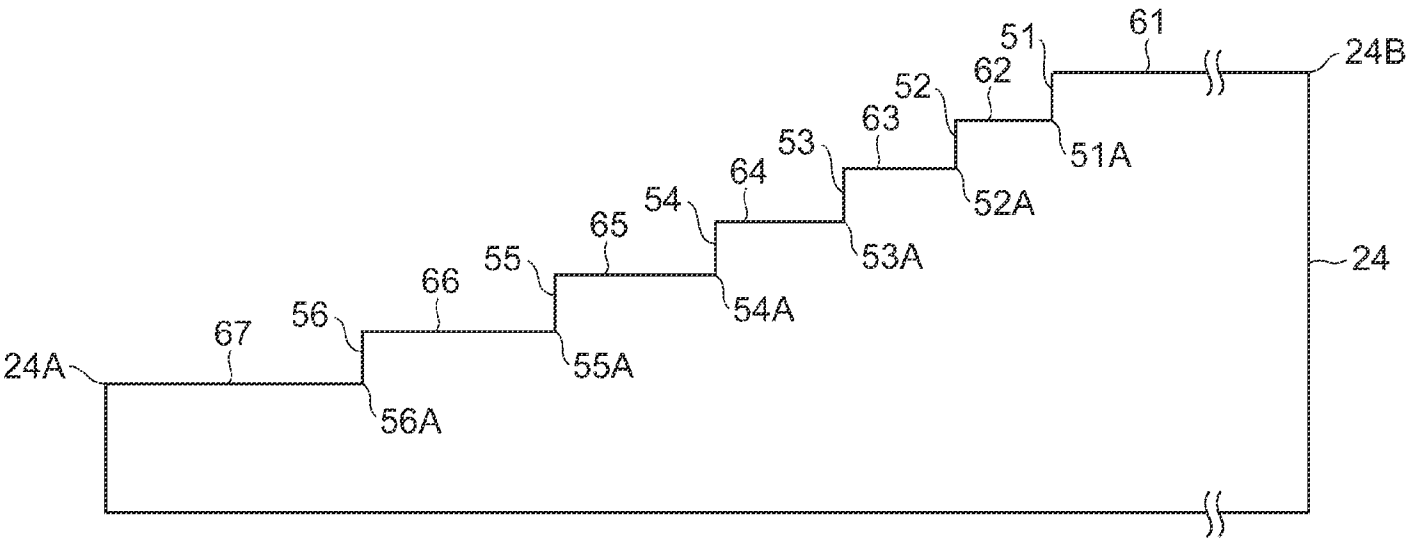
FIG. 4 is a view showing a state in which the lap of each scroll is expanded on a plane.
Figure 5:
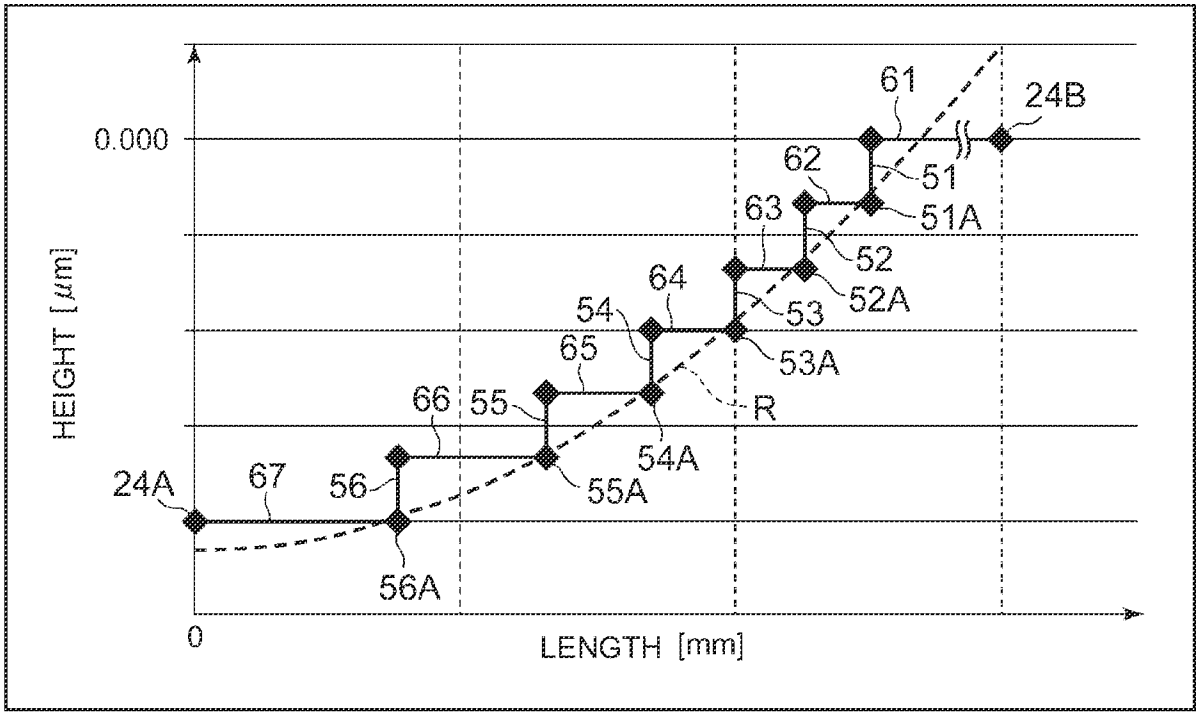
FIG. 5 is a graph describing the position and height of a step portion of a tip when the lap of the scroll is expanded as shown in FIG. 4.

This will be described using FIGS. 4 and 5. Incidentally, although the lap 24 of the fixed scroll. 21 will be described as an example in FIGS. 4 and 5, the lap 32 of the movable scroll. 22 is similar thereto in basic features. FIG. 4 is a view when the lap 24 of the fixed scroll 21 is expanded on a plane, and FIG. 5 is a view expressing in graph, the positions and heights of the step portions 51 to 56 at the tip when the lap 24 is expanded. Incidentally, although the heights of the step portions 51 to 56 are shown exaggerated in FIG. 4, they are actually on the order of μm.

In FIG. 5, the horizontal axis is the length of the lap 24 taken with the winding start portion 24A at the innermost periphery as a reference (0), and the vertical axis is the height of each of the tip portions 62 to 67 taken with the tip portion 61 (on the winding end portion 24B side) at the outermost periphery as a reference (0). In the present invention, as shown in FIG. 5, the base points 51A to 56A of the step portions 51 to 56 are set to be placed on a predetermined arc R drawn on the unfolded plane of the lap 24. This arc R is assumed to be set to a recess-shaped arc of each of the scrolls 21 and 22 actually measured after familiarization, or an arc close to it.

The heights of the step portions 51 to 56 are made the same in the embodiment. Further, as described above, the lap 32 of the movable scroll 22 is also set so that the base points of the step portions 71 to 76 are placed on a predetermined arc drawn on the unfolded plane of the lap 32. Further, in the embodiment, as shown in FIG. 2, each of the step portions 51 to 56 of the lap 24 of the fixed scroll 21 is taken as an arc shape (radial circle shape) concentric with the base circle of the spiral of the lap 24. As shown in FIG. 3, each of the step portions 71 to 76 of the lap 32 of the movable scroll 22 is taken as an arc shape (radial circle shape) concentric with the base circle of the spiral of the lap 32.

By doing so, the heights of the laps 24 and 32 of the scrolls 21 and 22 can be set to the form in which the scrolls 21 and 22 in a state of being worn by localized contact due to the influence of the compressive reaction force and thermal expansion, i.e., after being familiarized are close to an actual shape. Since the laps 24 and 32 comes into contact with the mirror plates 31 and 23 of the opposing scrolls 22 and 21 evenly from the start of the operation, it is possible to effectively suppress the occurrence of the localized contact and significantly shorten the so-called break-in time until the volumetric efficiency is saturated.

In particular, in the embodiment, since the step portions 51 to 56 and 71 to 76 are set as the arc shapes concentric with the base circles of the spirals of the laps 24 and 32, respectively, the heights of the laps 24 and 32 of the scrolls 21 and 22 can be made to correspond to the actual wear shapes of the scrolls 21 and 22 even more accurately, and the occurrence of the localized contact can be suppressed even more effectively.

Figure 6:
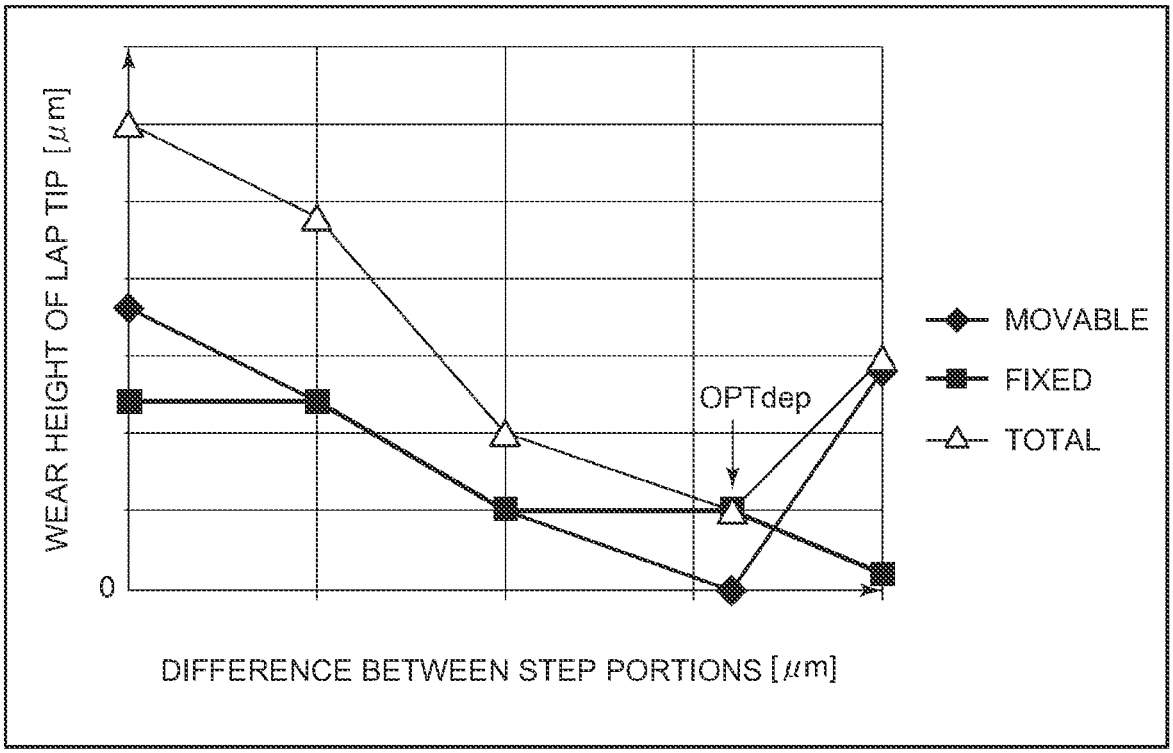
FIG. 6 is a graph showing the wear height of the lap tip of each scroll when the difference in height between a winding end portion of the lap of each scroll and a winding start portion thereof is changed.

Here, FIG. 6 is a graph in which the wear heights of the tips of the laps 24 and 32 of the scrolls 21 and 22 are actually measured (vertical axis) when the difference in total between the step portions 51 to 56 of the fixed scroll 21 each set as such a shape as described above (the difference in height between the tip portion 61 of the winding end portion 24B and the tip portion 67 of the winding start portion 24A), and the difference in total between the step portions 71 to 76 of the movable scroll 22 (the difference in height between the tip portion 81 of the winding end portion 32B and the tip portion 87 of the winding start portion 32A) are changed (horizontal axis). As is also clear from this figure, the wear of the tips of the laps 24 and 32 becomes the smallest at a value (difference in the total between the step portions) shown by OPTdep in FIG. 6.

Further, in the embodiment, as shown by X1 in FIG. 2, the outermost step portion 51 of the fixed scroll 21 is positioned 270 deg inside from the winding end portion 241. As shown by X2 in FIG. 3, the outermost step portion 71 of the movable scroll 22 is also positioned 270 deg inside from the winding end portion 32B. Incidentally, since the step portions 51 and 71 assume the arc shapes as described above in the embodiment, the position of 270 deg is set to the center of the are of each of the step portions 51 and 72.

Thus, by setting the positions of the step portions 51 and 71, the stability at the time that the scrolls 21 and 22 are placed on a workbench with the laps 24 and 32 facing down is improved, and the standard at the time of setting the heights of the laps 24 and 32 also becomes easy to be taken. Incidentally, in this embodiment, the positions of the step portions 51 and 71 are set to be located 270 deg inside, but not limited thereto. As long as they are located 180 deg or more inside, the scrolls 21 and 22 become stable.

Incidentally, in the embodiment, as described above, the fixed scroll. 21 in which the center of the base circle of the spiral of the lap 24 and the center of the mirror plate 23 coincide with each other is adopted, and the movable scroll 22 in which the center of the base circle of the spiral of the lap 32 and the center of the mirror plate 31 coincide with each other is adopted. Each of the step portions 51 to 56 of the lap 24 of the fixed scroll 21 is formed into the arc shape concentric with the base circle of the spiral of the lap 24, and each of the step portions 71 to 76 of the lap 32 of the movable scroll 22 is formed into the arc shape concentric with the base circle of the spiral of the lap 32, but they are not limited thereto. By forming each of the step portions 51 to 56 into a concentric arc shape and also forming each of the step portions 71 to 76 into a concentric arc shape, the occurrence of the localized contact can be effectively suppressed. The reason is that, as described above, each of the scrolls 21 and 22 after the break-in time has elapsed is cut into the shape made concave in cross section in an arcuate form.

However, as in the embodiment, each of the step portions 51 to 56 of the lap 24 of the fixed scroll 21 is set to the arc shape concentric with the base circle of the spiral of the lap 24, and each of the step portions 71 to 76 of the lap 32 of the movable scroll 22 is set to the arc shape concentric with the base circle of the spiral of the lap 32, thereby enabling the localized contact to be suppressed even more effectively.

Also, unlike the embodiment, the centers of the base circles of the spirals of the laps of the fixed scroll and the movable scroll may be different from the centers of the mirror plates. In such a case, each of the step portions 51 to 56 may be formed into an arc shape concentric with either the base circle of the spiral of the lap 24 or the mirror plate 23, and each of the step portions 71 to 76 may be formed into an arc shape concentric with either the base circle of the spiral of the lap 32 or the mirror plate 31. That is, the center of the arc of each of the step portions 51 to 56 and 71 to 76 is aligned with either the center of the base circle of the spiral of each of the laps 24 and 32 or the center of each of the mirror plates 23 and 31, thereby making it possible to more effectively suppress the occurrence of the localized contact.

Further, in the embodiment, the present invention is applied to the scroll compressor used in the refrigerant circuit of the vehicle air conditioning device, but is not limited thereto. The present invention is effective for a scroll compressor used in refrigerant circuits of various refrigerating devices. Further, in the embodiment, the present invention is applied to the so-called inverter-integrated scroll compressor, but is not limited thereto. The present invention can also be applied to a normal scroll compressor which is not integrally provided with an inverter.

DESCRIPTION OF REFERENCE NUMERALS

1 scroll compressor
4 compression mechanism
11 housing
21 fixed scroll
22 movable scroll
23, 31 mirror plate
24, 32 lap
24A, 32A winding start portion
24B, 32B winding end portion
34 compression chamber
39 back pressure chamber
51 to 56, 71 to 76 step portion
61 to 67, 81 to 87 tip portion.

The invention claimed is:

1. A scroll compressor comprising:

a compression mechanism including a fixed scroll and a movable scroll respectively formed on surfaces of mirror plates with spiral laps facing each other, wherein the movable scroll is revolved and turned with respect to the fixed scroll to move a compression chamber formed between the laps of both scrolls from the outside to the inside while reducing the compression chamber to thereby compress a working fluid, wherein the laps of the fixed scroll and the movable scroll are configured to have a plurality of step portions between a winding end portion at an outermost periphery and a winding start portion at an innermost periphery and decrease stepwise in height toward the winding start portion from the winding end portion, and wherein the position and height of each of the step portions are set so that a base point of each step portion is placed on a predetermined arc drawn on a predetermined plane upon expanding each of the spiral laps on the predetermined plane, wherein each of the step portions has a concentric arc shape, and wherein each of the step portions has an arc shape concentric with a base circle of a spiral of each of the laps or the mirror plate.

2. The scroll compressor according to claim 1, wherein the step portion on the outermost side is positioned 180 deg or more inside from the winding end portion.

3. The scroll compressor according to claim 2, wherein the step portion on the outermost side is positioned 270 deg inside from the winding end portion.

* * * * *